US005145181A

United States Patent [19]

Welman et al.

[11] Patent Number: 5,145,181

[45] Date of Patent: Sep. 8, 1992

[54] BOARD GAME APPARATUS

[76] Inventors: David M. Welman; Antonie C. F. Welman, both of 205 Hazelmere Court, CNR Landsdowne & Markham Roads, Claremont, Cape Town, Cape Town Province; Peter H. G. Wilson, 44 Kenwood Road, Fish-Hoek, Cape Province, all of South Africa

[21] Appl. No.: 430,159

[22] Filed: Nov. 1, 1989 (Under 37 CFR 1.47)

[30] Foreign Application Priority Data

Nov. 1, 1988 [ZA] South Africa ..... 88/8177

[51] Int. Cl.[5] ..... A63F 3/02

[52] U.S. Cl. ..... 273/237; 273/239; 273/241; 273/261; 273/280

[58] Field of Search ..... 273/241, 261, 239, 280, 273/142 H, 237

[56] References Cited

U.S. PATENT DOCUMENTS 2,481,779 9/1949 Peterson ..... 273/280
3,359,003 12/1967 Kass ..... 273/239
3,661,391 5/1972 Henshaw ..... 273/261
3,776,554 12/1973 Capablanca et al. ..... 273/261
3,897,063 7/1975 Lehwalder ..... 273/280

FOREIGN PATENT DOCUMENTS 2178327 2/1987 United Kingdom .

OTHER PUBLICATIONS

Popular Mechanics "Global Chess" p. 110, Aug. 1972.
Games Magazine "The $100,000 Gambit", pp. 18-20, Jan.-Feb. 1981.

*Primary Examiner*—Benjamin Layno
*Attorney, Agent, or Firm*—Burns, Doane, Swecker & Mathis

[57] ABSTRACT

Game apparatus defines an effectively spherical playing surface which is divided into ranks and files of blocks. The playing surface has at least two poles, and the files extend radially from respective poles, while the ranks are arranged concentrically about the poles. In one embodiment, the apparatus defines a spherical playing surface. In other embodiments, two or more discs represent hemi-spherical playing surfaces. The discs can be rotated synchronously to facilitate the movement of pieces from disc to another, simulating a true spherical playing surface.

8 Claims, 3 Drawing Sheets

Fig. 1
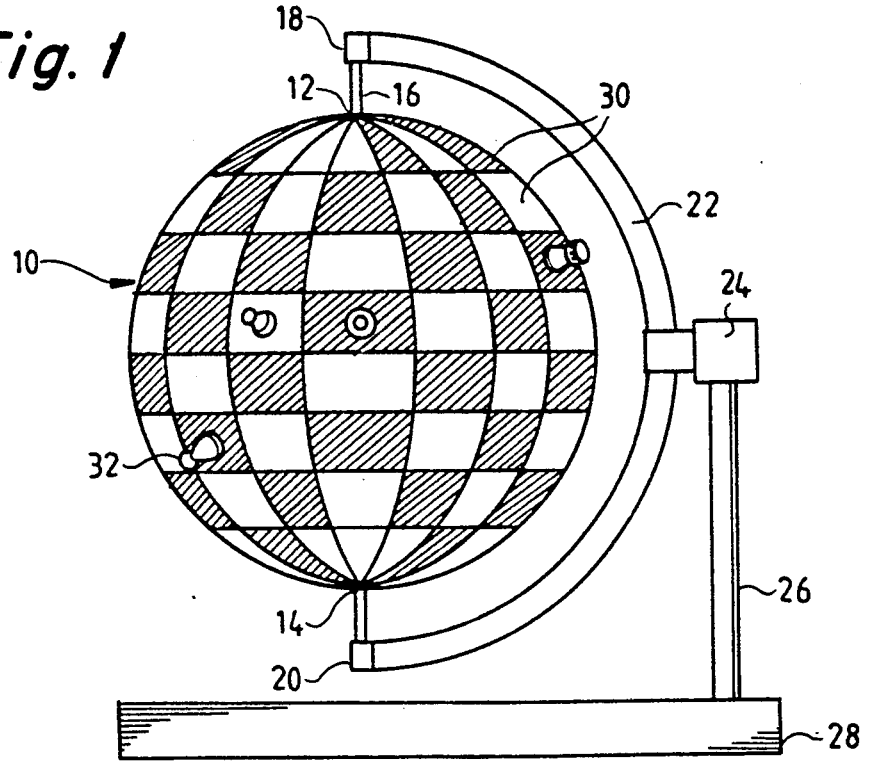
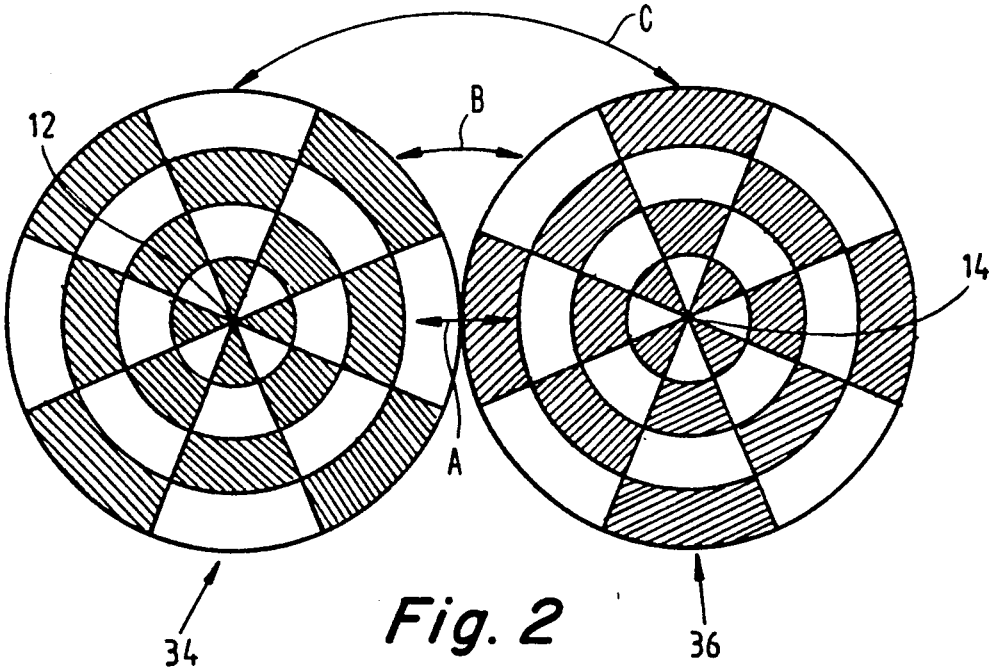
Fig. 2

BOARD GAME APPARATUS

BACKGROUND OF THE INVENTION

This invention relates to game apparatus for playing chess, draughts or checkers, or similar games.

Game board apparatus has been proposed, in U.S. Pat. No. 3,897,063 to Lehwalder, which comprises a plurality of discs mounted rotatably on a further, larger disc in a sun gear/planetary gear arrangement. Each disc is marked with a conventional 64-square chess board, and rotation of the assembly swings the discs past a seated player in such a way that boards are correctly oriented towards the player.

Other variations of conventional chess boards have been proposed, involving circular boards or multi-tiered boards. Examples include German Offenlegungsschrift no. 3,221,522 and German patent no. 1,811,687.

It is an object of the invention to provide alternative game apparatus.

SUMMARY OF THE INVENTION

According to the invention there is provided game apparatus defining a playing surface which is divided into ranks and files of blocks, the playing surface having at least two poles, a plurality of files extending radially from each pole and a plurality of ranks arranged concentrically about each pole.

The playing surface may be defined by a spherical or spheroidal body, the poles being at opposite ends of a polar axis of the body, the ranks being coaxial about the polar axis and the files extending between the poles.

The body may be mounted rotatably on a support for rotation about the polar axis.

Preferably, the body has a surface of a material to which the bases of suitable playing pieces are adherant.

In a preferred embodiment of the invention, the playing surface is defined by at least two discs, each disc having a central pole, a plurality of ranks disposed concentrically about the pole and a plurality of files extending radially from the pole, so that the portion of the playing surface defined by each disc represents a projection of a hemi-spherical or hemi-spheroidal playing surface.

Preferably, each disc is rotatable about its respective pole, synchronisation means being provided to ensure synchronous rotation of the discs.

The discs may be co-planar, the periphery of each disc being adjacent to the periphery of another disc.

The apparatus may comprise at least three discs disposed about an auxiliary disc, the auxiliary disc being rotatable synchronously with the three discs and being marked complementally thereto to supplement the playing area defined by the three discs.

Preferably, the three discs overlie the auxiliary disc.

BRIEF DESCRIPTION OF THE DRAWINGS

FIG. 1 is a schematic view of a first embodiment of game apparatus according to the invention;

FIG. 2 is a top view of a second embodiment of the invention;

DESCRIPTION OF EMBODIMENTS

Figure 3:
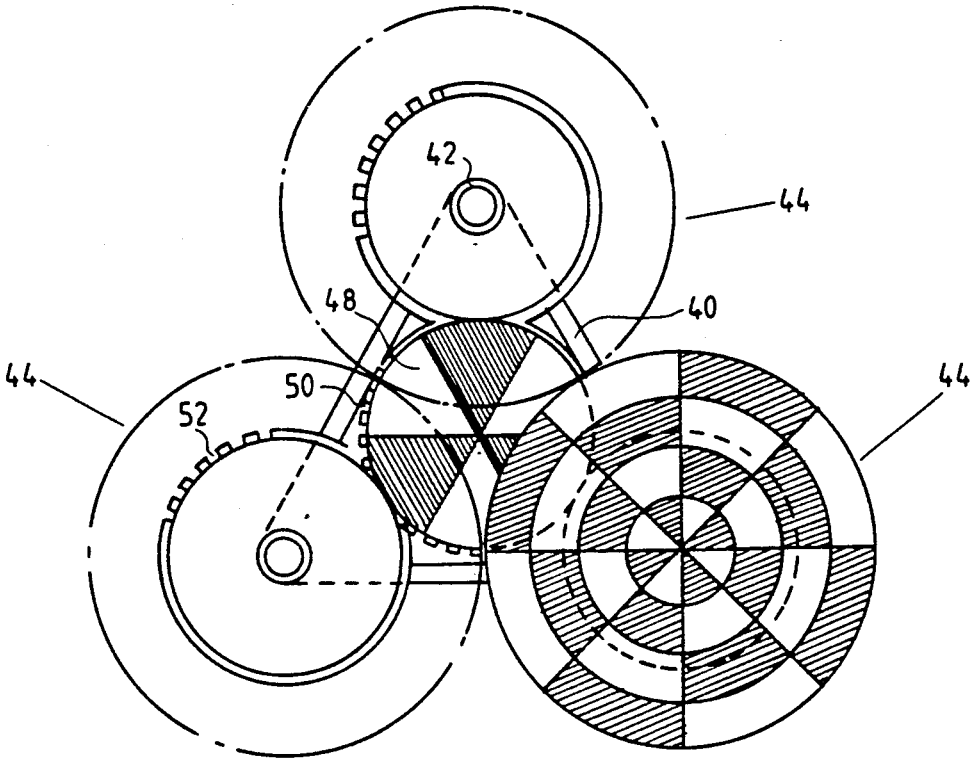
FIG. 3 is a partially cut-away top view of a third embodiment of the invention.

The embodiment of the game apparatus shown in FIG. 1 comprises a spherical or spheroidal body 10 which has opposed poles 12 and 14 at each end of a polar axis passing through the body. The axis is coincident with a shaft 16 which extends through the body 10. The ends of the shaft 16 are received in bushes 18 and 20 of a gimbal 22, so that the body is rotatable about the shaft 16 and thus about its polar axis. The gimbal 22 is rotatable relative to a mounting bracket 24 fitted to the top of an arm 26 which is fixed to a base 28. The apparatus can thus be placed on a suitable surface, such as a table, and the body 10 can be rotated as desired so that any portion of the surface thereof is accessible.

The surface of the body 10 defines a playing surface with files extending essentially longitudinally between the poles 12 and 14, and concentric ranks disposed essentially latitudinally between the poles. Thus, it can be seen that the files extend essentially radially from the poles, while the ranks are disposed concentrically about the poles. Each rank contains eight latitudinally aligned blocks 30, and each file contains eight longitudinally aligned blocks 30. Alternate blocks are coloured differently (for example, black and white) in the manner of a conventional chess board. It will thus be apparent that the playing surface defined by the body 10 has 64 blocks 30, which is the same number of blocks as a conventional chess board. The shape of the blocks varies, of course, with the distance from the poles.

The body 10, which may be formed from a tough plastics material, is covered with a layer of ferromagnetic material such as thin steel sheet. Alternatively, a small piece of steel sheet can be applied to the surface of each block. Magnetised chess pieces 32 are placed on the blocks and adhere thereto, so that rotation of the body does not cause the pieces to fall off the playing surface.

Assuming that the described apparatus is used to play chess, the opponents arrange their pieces in the two ranks closest to the respective poles 12 and 14. The ranks closest to the poles can be considered to be "wrapped around" the poles, and correspond to the opposed ends of a conventional chess board. The chess pieces move in a conventional manner, and the rules of the game can be essentially identical to normal chess rules. However, the provision of a spherical playing surface effectively eliminates the edges of the board, greatly increasing the number of possible moves which can be made, and effectively allowing the playing of a "three dimensional" game.

For various reasons, including reasons of cost and space, it may not be desirable to provide a spherical playing surface. However, the same effect can be simulated by projecting the two hemispheres of the spherical surface illustrated in FIG. 1 onto a pair of discs, as shown in FIG. 2. If the sphere of FIG. 1 is split along its equator, and the portions of the playing surface on the two resulting hemispherical halves are projected onto a pair of discs, a playing surface will be obtained as illustrated in FIG. 2. The peripheries of the discs 34 and 36 in FIG. 2 correspond to the equator of the sphere in FIG. 1, while the poles 12 and 14 are located at the centers of the respective discs. On each disc 34, 36, four ranks of eight latiudinally blocks each are arranged concentrically about the pole 12, 14, while eight files of four longitudinally blocks each extend radially outwardly from the poles. If chess pieces are allowed to move from disc to disc between blocks which would have been longitudinally adjacent to one another across the equator of the corresponding spherical playing surface, the effect of a spherical playing surface is achieved with a planar apparatus. The arrows A, B, C in FIG. 2 show a few pairs of blocks which are "longitudinally adjacent" to one another in this sense. Only pair of the blocks (i.e., the blocks interconnected by arrow A) are disposed radially opposite one another (with reference to the radii of the discs 34, 36).

Figure 4:
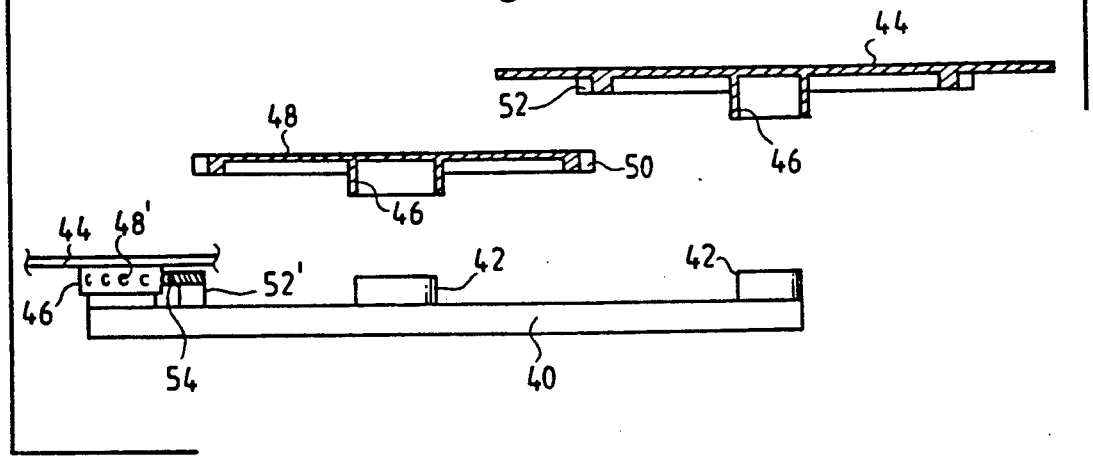
FIG. 4 is a partial sectional exploded side view of the embodiment of FIG. 3.

Because it will be difficult, in practice, to keep in mind the possible moves between adjacent equatorial blocks on the two discs 34 and 36, it is desirable to mount the discs rotatably to allow synchronous rotation thereof, so that corresponding blocks can be brought into alignment to facilitate play and the visualising of possible moves. An embodiment of the game apparatus having three mutually rotatable discs is illustrated in FIGS. 3 and 4. (It should be appreciated that the provision of two, three or more discs is a matter of choice. Whereas the provision of two discs allows a truly spherical playing surface to be represented, the provision of three or more discs simply adds further hemispheres to the effective playing surface).

The apparatus of FIGS. 3 and 4 comprises a frame 40 which is conveniently molded from tough plastics material. The frame 40 is generally triangular and defines cylindrical sleeves 42 at its apices on which three main discs 44 are respectively mounted rotatably by means of cup-shaped bearing formations 46 which fit over the upper ends of the sleeves 42. At the center of the frame is a further sleeve 42, on which an auxiliary disc 48 is mounted rotatably. The periphery of the auxiliary disc 48 is provided with teeth 50, while a toothed ring 52 is formed on the bottom surface of each disc 44. When the discs 44 and 48 are assembled onto the frame 40, the toothed periphery of the auxiliary disc 48 meshes with the toothed rings on the lower surfaces of the discs 44, so that rotation of any one disc causes the other discs to rotate synchronously.

On the outer surface of the bearing cup 46 of one of the discs 44 a circular row of indentations 48' is formed. On the frame 40 is a bracket 52' which houses a spring loaded finger 54 which bears against the cup 46. As the disc 44 rotates, the finger 54 tends to seat in the depressions 48 as they rotate past the finger, so that the disc 44 tends to stop when each of the indentations passes the finger. The indentations are aligned so that the discs tend to stop as they are rotated into correct alignment for the playing of the game.

Figure 6:
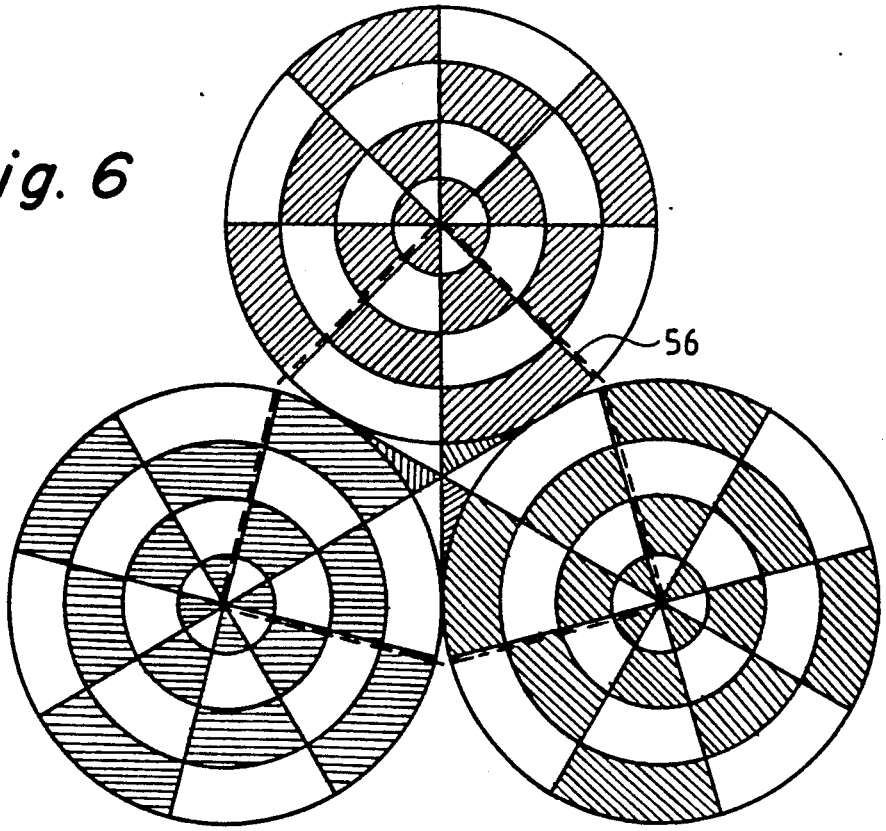
FIG. 6 is a schematic top view of the apparatus of FIG. 3, illustrating the playing surface defined by the apparatus.

The upper surfaces of the discs 44 are marked as illustrated in FIG. 2. It will also be seen that the upper surface of the auxiliary disc 48 is marked complementally to the surfaces of the discs 44, to supplement the playing area defined by the three discs 44. The upper surface of the auxiliary disc 48 is divided into six sectors disposed about the center of the auxiliary disc, and which supplement the playing surface defined by the discs 44 as shown in FIG. 6. The hexagonal area 56 indicated in dotted outline in FIG. 6 is defined as a "battle zone", and includes two peripheral blocks on each disc 44 from which pieces can be moved to adjacent blocks of adjoining discs. The markings on the auxiliary disc 48 help to define the boundaries between the adjoining blocks, to facilitate visualisation of possible moves.

Figure 5:
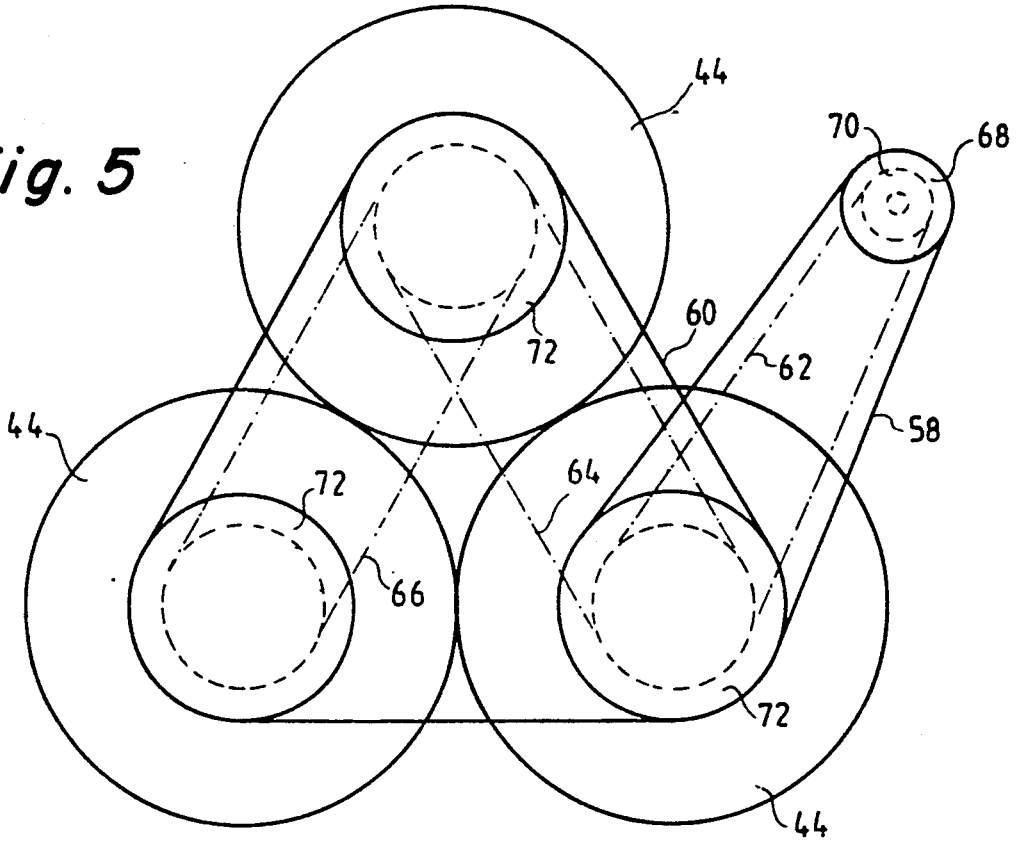
FIG. 5 is a schematic illustration of an alternative drive system for the embodiment of FIGS. 3 and 4.

Finally, FIG. 5 illustrates schematically a different drive arrangement of the discs 44, using belts 58 and 60, or 63, 64 and 66 to drive the discs synchronously. The belts 58 or 62 are driven by a pulley 68 mounted on a shaft of an electric motor 70. Each disc 44 has a hub 72 which the respective belts engage to drive the discs. The belts can be toothed complementally to the hubs to ensure synchronous rotation of the discs. Instead of a motor 70, a hand driven winder can be provided to rotate the discs.

The described apparatus allows the conventional game of chess to be "expanded" substantially, without significantly changing the rules of the game. The chess pieces move according to the same rules, but the effectively spherical playing surface means that certain pieces, such as a queen or bishop, can move relatively great distances over the playing surface, since there are no edges. The number of different moves which must be considered increases considerably, making the game more challenging. The use of three or more discs to define the playing surface allows three or more players to take part in a game. In such an arrangement, each pair of adjacent discs defines a spherical playing surface between them, so that the possibilities of the game are greatly increased.

We claim:

1. Game apparatus for simulating a spherical playing surface, comprising at least two substantially coplanar discs each defining a portion of a playing surface, the portion of the playing surface defined by each disc comprising a plurality of ranks disposed concentrically about a central pole and a plurality of files extending radially from the pole, so that the portion of the playing surface defined by each disc constitutes a projection of a hemispherical portion of a playing surface, two said hemispherical portions together simulating a spherical playing surface comprised of longitudinally aligned blocks and latitudinally aligned blocks, the poles of the hemispherical portions being mutually parallel, and the discs being disposed adjacent one another so that a block on one disc can be disposed in radially opposite relationship to a block on another disc with the two radially opposing blocks constituting longitudinally adjacent blocks of the simulated spherical playing surface, each disc being rotatable about its respective pole, and the discs being constrained for synchronous rotation in order to enable longitudinally adjacent blocks of the simulated spherical playing surface to be selectively positioned in said radially opposite relationship.

2. Apparatus according to claim 1 comprising at least three discs disposed about an auxiliary disc, the auxiliary disc being rotatable synchronously with the three discs and being marked complementally thereto to supplement the playing area defined by the three discs.

3. Apparatus according to claim 2 wherein the three discs overlie the auxiliary disc.

4. Apparatus according to claim 1 wherein the discs are toothed and engage one another so that rotation of one disc causes synchronous rotation of all discs.

5. Apparatus according to claim 1 wherein the discs are arranged to be driven synchronously by belt means.

6. Apparatus according to claim 1 wherein an electric motor is arranged to rotate the discs.

7. Apparatus according to claim 1 wherein an alignment mechanism is provided to facilitate correct alignment of the discs relative to one another as they are rotated from one position to another.

8. Apparatus according to claim 7 wherein the alignment mechanism comprises a series of spaced formations on one of the discs and a finger biased resiliently towards the formations so that the disc tends to stop as the finger passes each formation.

* * * * *